US008792671B2

(12) United States Patent
Sancisi et al.

(10) Patent No.: US 8,792,671 B2
(45) Date of Patent: Jul. 29, 2014

(54) SHAKER-TYPE TRANSDUCER WITH CENTERING DEVICE

(75) Inventors: Carlo Sancisi, Chiaravalle (IT); Andrea Falcioni, Marzocca di Senigallia (IT)

(73) Assignee: Ask Industries Societa' per Azioni, Monte San Vito (AN) (IT)

( * ) Notice: Subject to any disclaimer, the term of this patent is extended or adjusted under 35 U.S.C. 154(b) by 222 days.

(21) Appl. No.: 13/395,018

(22) PCT Filed: Sep. 2, 2010

(86) PCT No.: PCT/EP2010/062867

§ 371 (c)(1),
(2), (4) Date: Mar. 8, 2012

(87) PCT Pub. No.: WO2011/029768

PCT Pub. Date: Mar. 17, 2011

(65) Prior Publication Data

US 2012/0170795 A1 Jul. 5, 2012

(30) Foreign Application Priority Data

Sep. 9, 2009 (IT) ..... AN2009A000058

(51) Int. Cl.
*H04R 1/00* (2006.01)

(52) U.S. Cl.
USPC ..... 381/404; 381/403; 381/413; 381/396

(58) Field of Classification Search
USPC ..... 381/404, 412, 413
See application file for complete search history.

(56) References Cited

U.S. PATENT DOCUMENTS 3,833,404 A * 9/1974 Sperling et al. ..... 428/413
4,064,376 A 12/1977 Yamada
4,163,876 A * 8/1979 Ohnuki ..... 381/347
4,508,941 A * 4/1985 Wiggins ..... 381/412
5,898,786 A * 4/1999 Geisenberger ..... 381/412
6,067,365 A * 5/2000 Morenz ..... 381/412
6,618,487 B1 * 9/2003 Azima et al. ..... 381/152
2005/0184607 A1 * 8/2005 Nakajima et al. ..... 381/412

FOREIGN PATENT DOCUMENTS

WO 02-39781 A2 5/2002
WO 2007-046836 A2 4/2007

OTHER PUBLICATIONS

International Search Report for PCT/EP2010/062867 mailed Nov. 9, 2010.

* cited by examiner

*Primary Examiner* — Duc Nguyen
*Assistant Examiner* — Taunya McCarty
(74) *Attorney, Agent, or Firm* — Lowe Hauptman & Ham, LLP

(57) ABSTRACT

A shaker transducer is disclosed, which comprises a magnetic unit (1) composed of a magnet (3) disposed between a first polar plate (2) and a second polar plate (4) in such a way to generate a toroidal air gap (5). A sound coil (6) is disposed in the air gap (5) to move axially and a centering element (100) is fixed to the coil to maintain it centered with respect to the magnetic unit (1). A rigid element (10) comprising a shank (12) fixed to said cylindrical support (61) of the sound coil and adapted to be anchored to a surface to transfer the sound vibrations generated by the magnetic unit (1). The centering element (100) comprises a central cylindrical shank (101) fixed to the coil, a peripheral shank (102) fixed to the second polar plate (4) and a plurality of elastic spokes (103, 103') disposed between said central shank (101) and said peripheral shank (102).

7 Claims, 5 Drawing Sheets

SHAKER-TYPE TRANSDUCER WITH CENTERING DEVICE

RELATED APPLICATIONS

The present application is a National Phase of International Application Number PCT/EP2010/062867, filed Sep. 2, 2010, and claims priority from, Italian Application Number AN2009A000058, filed Sep. 9, 2009.

The present patent application for industrial invention relates to a magneto-dynamic transducer of shaker or exciter type provided with improved centering system of the mobile coil.

Referring to FIG. 1, a magneto-dynamic transducer according to the prior art is disclosed. The transducer comprises a magnetic unit generally indicated with numeral (1).

The magnetic unit (1) comprises a permanent magnet (3), generally ferrite, with toroidal shape that is disposed between a first polar plate (2) and a second polar plate (4). The second polar plate (4) is toroidal like the magnet (3); whereas the first polar plate (2) has a core (20) adapted to be inserted, with some clearance, into the holes of the magnet and of the second polar plate, in such a way to form a toroidal air space called air gap (5).

Although a toroidal magnet (3) (generally ferrite) is illustrated in the figures, as it is known in the art the magnetic unit (1) can also consist in disc-shaped magnets (generally neodymium) disposed in the core (20).

The terms "first polar plate (2)" and "second polar plate (4)" indicate any element that is disposed on either side of the magnet. Therefore, the first polar plate (2) can also have a cup-like shape, as it is well known in the art, and the second polar plate (4) can have a disc-like shape.

In any case, the magnetic unit (1) must be able to generate a toroidal air gap (5).

A sound coil (6) comprises an empty cylindrical support (61) on which a winding (60) is wound. The sound coil (6) is put on the core (20) of the first polar plate in such a way to move axially in the air gap (5).

It is extremely important that the sound coil (6) is perfectly centered in the air gap (5), in such a way not to go in contact with the core (20), the second upper plate (4) and the magnet (3). Suitable centering systems (8) provide for centering the sound coil (6). The function of a centering system is to guarantee the axial movement of the coil inside the air gap, thus avoiding any noise due to mechanical interference.

In the following text identical elements or elements that correspond to the ones that have already been described are indicated with the same numerals, omitting their detailed description.

Recently the application of magneto-dynamic transducers with rigid bodies that are put into vibration to generate a sound has become more and more popular. Such a type of sound diffusers is generally known as shakers or exciters. Unlike speakers, in shakers the coil remains still and the magnetic unit moves axially, thus transferring energy to the surface to be put into vibration.

Because of the fact that there is no membrane, which also acts as centering device, shakers have been impaired by problems in maintaining the sound coil aligned with respect to the mobile magnetic unit. In fact, the centering device by itself is not able to constrain the magnetic unit to move in parallel direction to the axis of the transducer, and therefore additional anchoring of the sound coil is necessary.

Such a drawback is at least partially solved in U.S. Pat. No. 5,424,592 that discloses a special structure of magneto-dynamic transducer that is substantially different from the traditional one. In fact, the sound coil is provided with an upper end that protrudes in upper position from the first upper polar plate and with a lower end that crosses the lower polar plate in order to protrude in lower position from it.

Consequently, a first centering element is fixed to the sound coil above the upper polar plate and a second centering element is fixed to the sound coil under the lower polar plate. Each centering element is shaped as a plate of synthetic material with a plurality of spiral-shaped openings in order to increase flexibility.

It appears evident that, although it guarantees good centering between the sound coil and the mobile magnetic system, such a solution is structurally complicated because the sound coil must be composed of two parts, connected in series, one of them wound in clockwise direction and the other one in anti-clockwise direction, in such a way that the magnetic induction coming out radially from the upper and lower polar plate, with opposite directions, gives force contributions that are summed up.

WO 2006/055801 discloses a traditional loudspeaker wherein the centering element is injection-molded and is an integral part of the loudspeaker basket. The spokes have an undulated shape with respect to a plane orthogonal to the axis of the centering element.

GB 2 392 795 and JP 09275598 disclose traditional loudspeakers with centering element comprising an internal ring and an external ring connected by arched, not planar spokes. The external ring has basically the same thickness as the spokes.

As it is known, the centering element of a traditional loudspeaker must have high stretchiness due to the relative lightness of the mobile system (membrane-coil). Therefore, such a centering element cannot be used in a shaker for the following reasons:

- stretchiness is too high,
- no planar development for minimum volume,
- need of relatively large dimensions to operate, whereas miniaturization is required for shakers.

U.S. Pat. No. 6,965,679 discloses a shaker-type loudspeaker that is provided with two centering elements made of fabric treated with resins (spiders) of known type. DE 2132018 discloses a shaker-type loudspeaker that couples a magneto-dynamic unit (mobile coil and magnetic circuit) directly to a surface, without using elastic elements. Transmitted vibrations are limited in the frequency band by the rigidity of direct coupling, due to the absence of elastic means that reduce resonance frequency of the inertial device.

It must be noted that the design of a shaker/exciter encounters more difficulties in finding a solution able to guarantee that during operation the coil maintains an axial movement that is concentric to the air gap of the magnetic circuit.

Obviously, such a characteristic must be maintained over time and for such a reason the elastic centering system must not yield during heavy operation.

For such a reason, traditional centering systems made of fabric treated with thermosetting resins are not suitable for use, being subject to yield, in particular when they must control relatively heavy masses.

In traditional loudspeakers the two spaced points of elastic constraint are found on the centering element and on the annular border of the peripheral suspension of the membrane of the loudspeaker. Instead, in a shaker without membrane, the two constraint points must be made by means of centering elements.

Shakers with only one centering element are available on the market, with evident problems to maintain the coil centered in the air gap because they do not guarantee axial movement. The problem to guarantee axial movement is a severe criticality for shakers, due to the fact that the masses to be controlled are by far higher than in a loudspeaker.

Given that the resonance frequency of a system depends on the reciprocal of the square root of the product of mass (Kg) by stretchiness (m/N), it appears evident that with the same frequency of the system, higher masses need to be coupled with springs with lower stretchiness (more rigid) and vice versa. Therefore, relatively low stretchiness is found in shakers/exciters.

The purpose of the present invention is to provide a shaker-type transducer provided with suitable centering system of the sound coil, which is easy and inexpensive to produce and meets the technical-functional requirements in addition to reliability and productive repeatability.

This purpose is achieved according to the present invention, with the characteristics illustrated in the attached independent claim 1. Advantageous embodiments appear from the dependent claims.

The shaker-type transducer according to the invention comprises:

- a magnetic unit composed of a magnet disposed between a first polar plate and a second polar plate in such a way to generate a toroidal air gap,
- a sound coil comprising an empty cylindrical support around which a winding is wound, said sound coil being disposed in the air gap and said cylindrical support of the coil being provided with a portion that protrudes from said second polar plate,
- a centering element positioned between the magnetic unit and the sound coil to maintain the coil centered with respect to the magnetic unit during the relative axial movement of the coil with respect to the magnetic unit and vice versa, and
- a rigid element comprising a shank connected to said cylindrical support of the sound coil and adapted to be anchored to a surface to transfer the sound vibrations generated by the magnetic unit.

The centering element comprises:

- a central cylindrical shank fixed to said protruding portion of the cylindrical support of the coil or to the magnetic unit,
- a peripheral shank fixed to the magnetic unit or to the protruding portion of the cylindrical support of the coil, and
- a plurality of elastic spokes arranged between said central shank and peripheral shank.

The spokes have a lower thickness than the height of said central shank, are equally spaced and planar with respect to a plane orthogonal to the axis of the central shank that coincides with the axis of the coil.

The centering element comprises a first set of spokes that lie on a first plane orthogonal to the axis of the central shank and at least a second set of spokes that lie on at least a second plane orthogonal to the axis of the central shank, at a certain distance from said first plane.

In this way the elastic spokes act as flat springs and maintain the sound coil perfectly centered during the relative axial movement of the coil with respect to the magnetic unit.

In the shaker of the invention, the axiality of the coil is maintained by means of a plurality of spaced spokes. Said spokes guarantee control of axial displacement of the coil by means of an elastic return force; the spokes also control, by means of radial centering forces acting on planes perpendicular to the axis of displacement of the coil, that the mobile coil does not make displacements transversal to its axis and therefore moves inside the air gap of the magnetic yoke, without creating noise due to mechanical interference.

Such a type of centering element allows for:

- controlled axial movement of the mobile coil and maintenance of its position in the air gap,
- low stretchiness of the elastic system, which can be controlled by acting on the geometry of the characterizing parts of the spokes of the centering element,
- small volume due to the use of flat spokes,
- the position of the springs on the structure is designed in such a way to guarantee self-centering assembly between the two parts that contain: the mobile coil and the magnetic system, respectively.

The shaker of the invention optimizes constructive simplicity, application of a self-centering system for couplings, with advantages for the economy of the product, also due to the inexpensiveness of components.

Additional characteristics of the invention will appear more evident from the following detailed description that refers to merely illustrative, not limiting embodiments, illustrated in the enclosed drawings, wherein.

Figure 1:
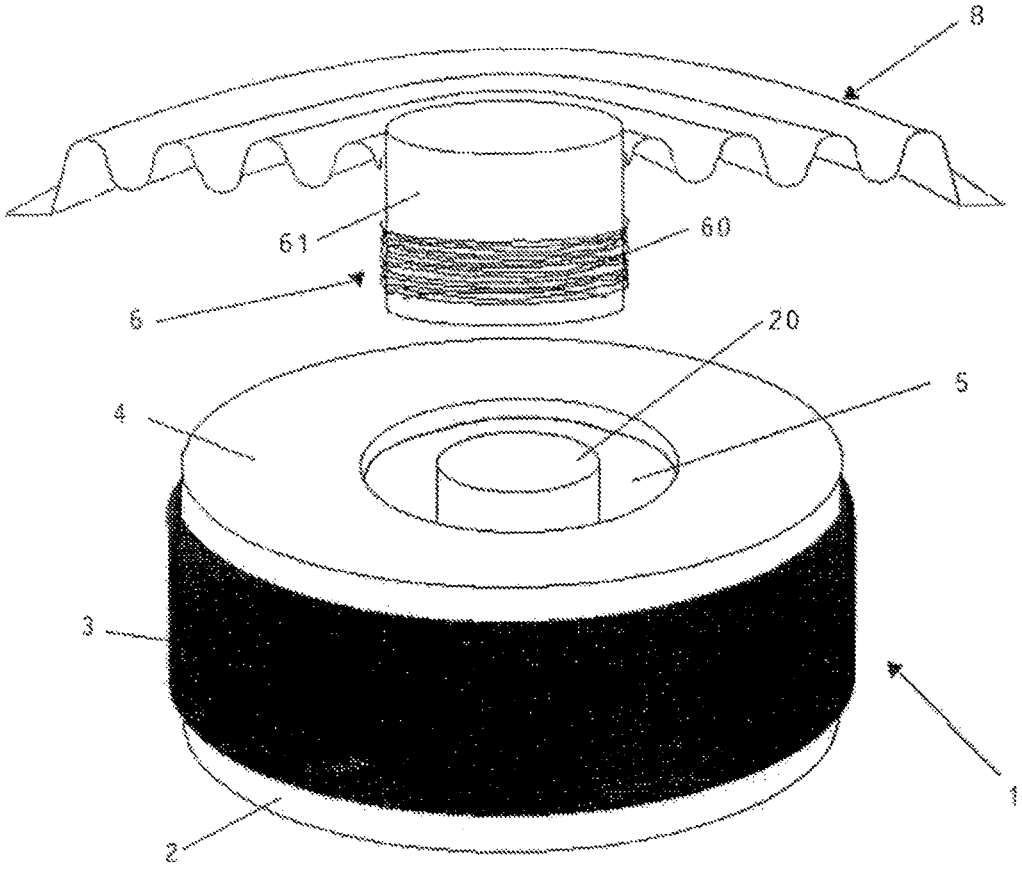
FIG. 1 PRIOR ART
FIG. 1 is a diagrammatic perspective view of a magneto-dynamic transducer according to the prior art and a centering element according to the prior art shown in a partially interrupted view.
Figure 2:
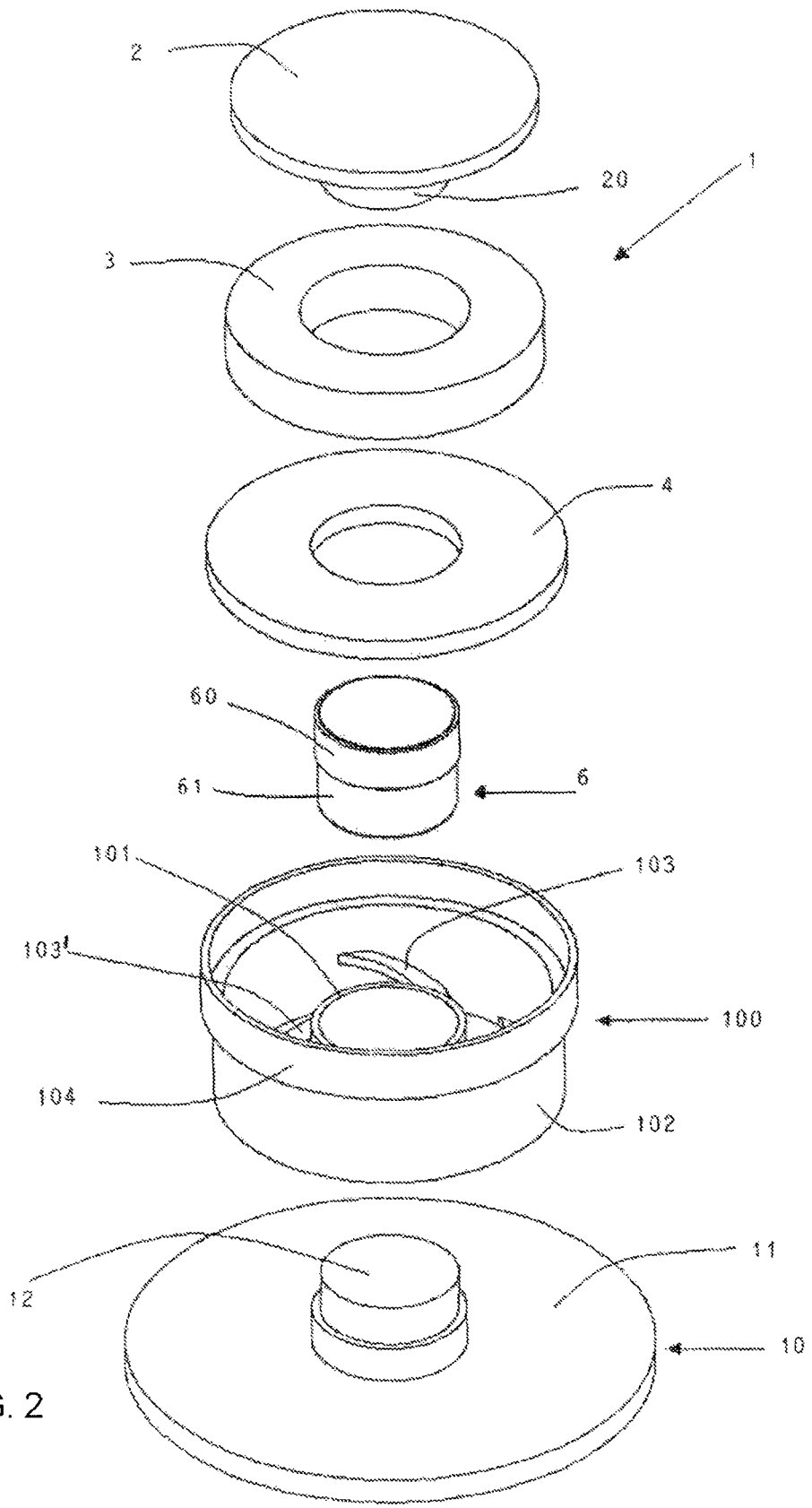
FIG. 2 is an exploded perspective view of a magneto-dynamic transducer provided with centering element of the invention, in configuration for sound diffuser of shaker type.
Figure 3:
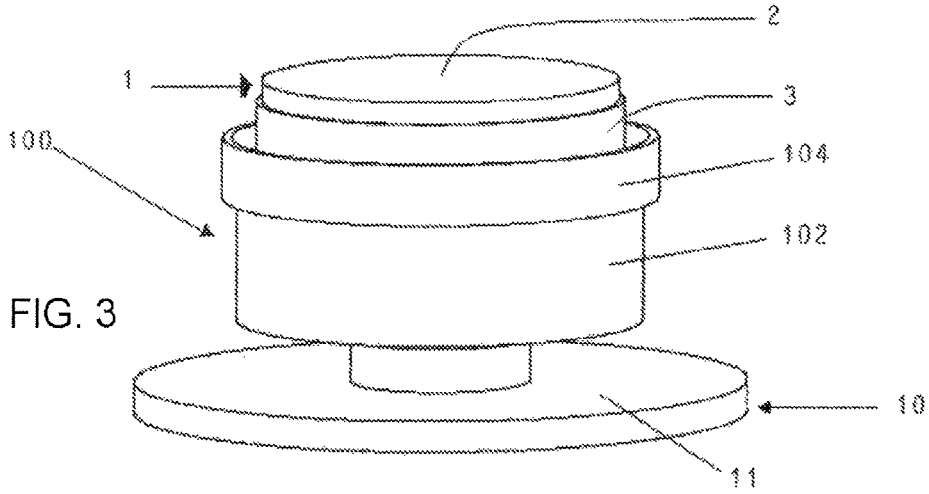
FIG. 3 is a perspective view of the transducer of FIG. 2 after assembly.
Figure 4:
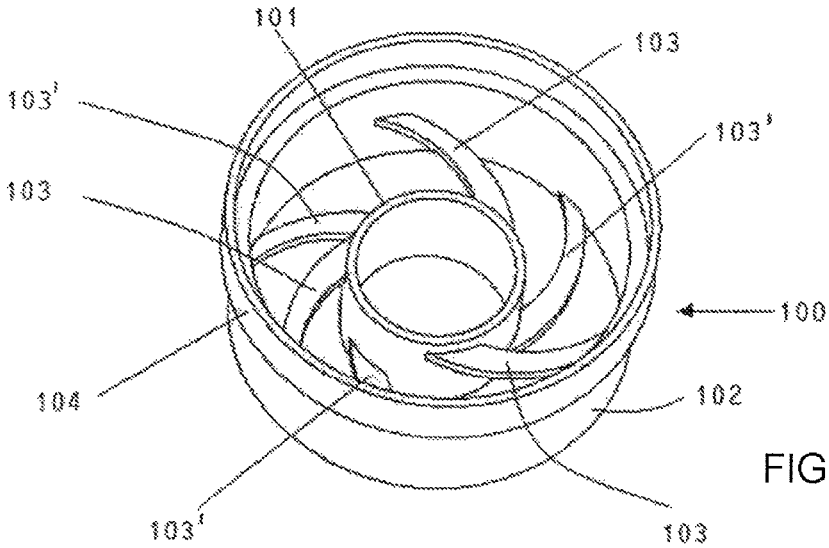
FIG. 4 is a perspective view of the centering element of the transducer of FIG. 2.
Figure 5:
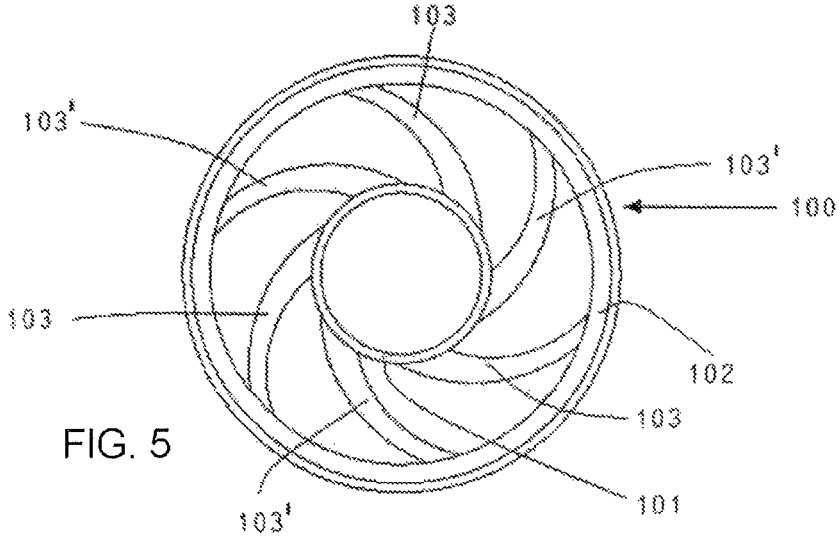
FIG. 5 is a top view of the centering element of FIG. 4.

Now referring to FIGS. 2-6 a centering element according to the invention is disclosed, which is generally indicated with numeral (100).

The centering element (100) comprises a central cylindrical shank (101) adapted to be fixed to the cylindrical support (61) of the sound coil (6), for example by means of gluing.

From the central cylindrical shank (101) a plurality of spokes (103, 103') branch off outwards, having lower thickness than the length of the central cylindrical shank, in such a way to be suitably flexible.

The spokes (103, 103') are connected to the internal surface of a peripheral cylindrical shank (102). The peripheral cylindrical shank (102) is longer than the central cylindrical shank (101).

The peripheral cylindrical shank (102) is provided with an annular flange (104) with higher diameter than the peripheral shank, adapted to be fixed to the second polar plate (4) of the transducer, for example by means of gluing.

Advantageously, a self-centering system can be provided between centering element (100), sound coil (6) and magnetic unit (1). Such a self-centering system can provide for insertion or fitting or bayonet means obtained on the peripheral flange (104).

In the transducer of shaker type a rigid element (10) is provided for connection to a surface in order to transfer the sound vibrations generated by the movement of the magnetic unit (1).

The flat rigid element (10) can be the bottom of a container that is closed with a suitable lid to contain the shaker. In addition to protect the shaker during operation, the purpose of the container is to characterize the aesthetics of the finished product.

For instance, the rigid element (10) is composed of a disc-shaped plate (11) provided with cylindrical shank (12) that axially protrudes upwards to be engaged into the central shank (101) of the centering element that supports the cylindrical support (61) of the sound coil (6).

In such a way, the axial movement of the magnetic unit (1) is guaranteed by the presence of the flexible spokes (103, 103') of the centering element (100) that act as springs.

Each flexible spoke (103, 103') is shaped as a flat plate with respect to a plane orthogonal to the axis of the centering element, in such a way to optimize the total volume of the centering element.

The flexible spokes (103, 103') are arranged on at least two planes orthogonal to the axis of the centering element (100) that coincides with the axis of movement of the magnetic unit (1). This generates a first set of spokes (103) arranged on a first plane orthogonal to the axis of the centering element and at least a second set of spokes (103') arranged on at least a second plane orthogonal to the axis of the centering element.

Such an arrangement of the spokes (103, 103') on multiple planes allows for maintaining a movement of the magnetic unit (1) that is perfectly axial to the coil (6), avoiding transversal oscillations of the magnetic unit (1) that would cause signal interference if the coil (6) interfered with the metal parts that surround the air gap.

According to the embodiment shown in the figures, the first set of spokes comprises three spokes (103) that are equally spaced by 120° and the second set of spokes is composed of three spokes (103') that are equally spaced by 120°. The two sets of spokes (103, 103') are mounted in staggered position in such a way to generate an angular distance of 60° between the spokes. In this way the centering system (100) can be injection-molded from plastic materials using only one mold.

Clearly, the spokes (103, 103') can vary in shape, thickness, and number. The number of the spokes (103, 103') can vary according to the stretchiness to be obtained by the general spoke system.

The spokes (103, 103') can be coated with damping material, such as thermoplastic rubber, to allow for correct damping of the general elastic system. In such a case, the centering element (100) can be obtained in one piece by co-molding plastic materials and traditional rubber.

For the same purpose, the cylindrical support (61) of the mobile coil can be filled with suitable material to ensure correct damping of the oscillation, such as polyurethane sponge.

The same cylinder (61) of the mobile coil can also contain two magnets with opposite polarity, in order to obtain magnetic dampening and contribute to the general stretchiness mainly generated by the system of elastic spokes. A first magnet is mounted on the core (20) of the first polar plate (2) and a second magnet with opposite polarity with respect to the first magnet is mounted and joined with the flat surface of the shank (12).

Figure 6:
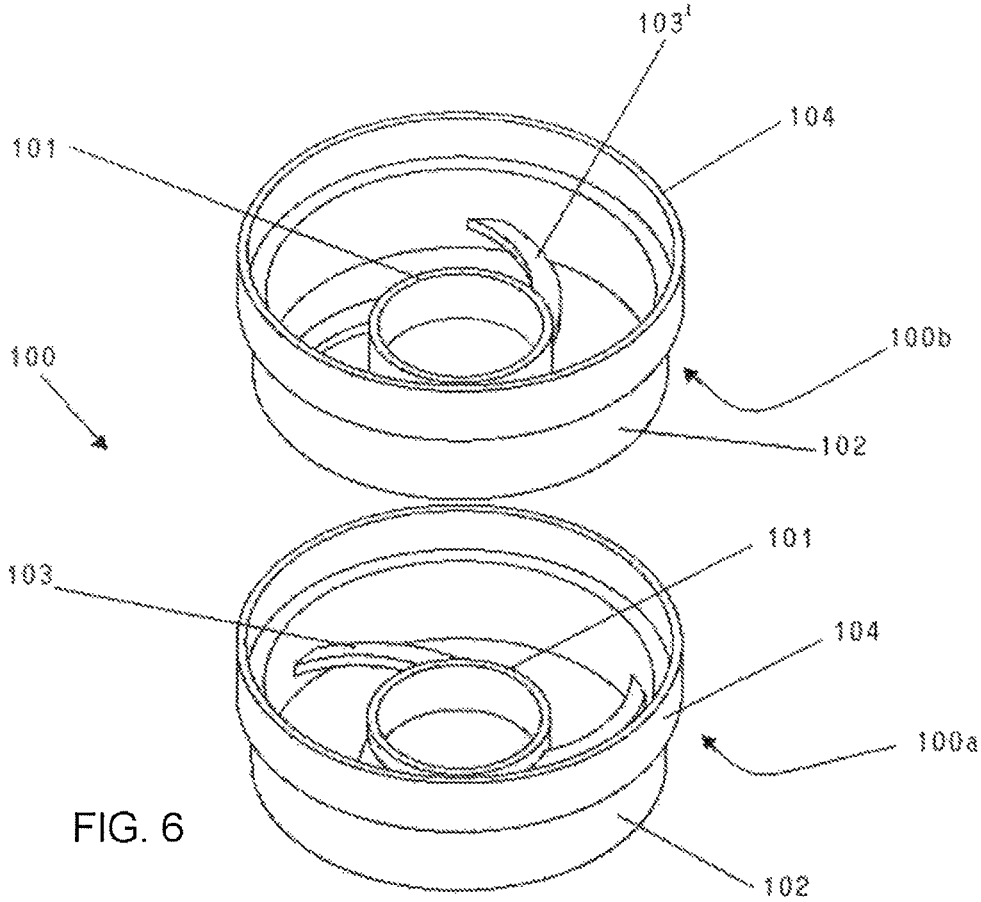
FIG. 6 is an exploded perspective view of a different version of the centering element of FIG. 4.
Figure 7:
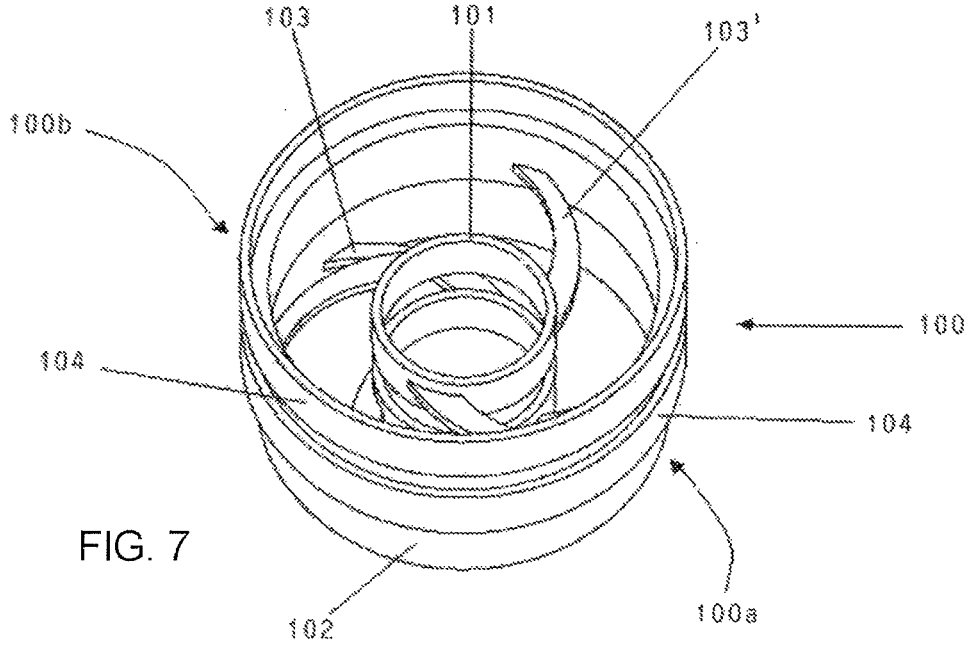
FIG. 7 is a perspective view of the centering element of FIG. 6 after assembly.

FIGS. 2 to 5 illustrate a centering element (100) made in one piece. However, as shown in FIGS. 6 and 7, the centering element (100) can be made of two separate elements (100*a*, 100*b*) that are assembled and firmly fixed, for instance by gluing.

In such a case the first centering part (100*a*) provides for a first set of spokes (103) and the second centering part (100*b*) provides for a second set of spokes (103') that are arranged on a lower plane than the first set of spokes (103) in mutually staggered position.

The first centering part (100*a*) is provided with an annular flange (104) fixed to the peripheral cylindrical shank (102) of the second centering part (100*b*), in such a way that the central shank (101) of the first element (100*a*) is positioned coaxially with respect to the central shank (101) of the second part (100*b*).

Figure 8:
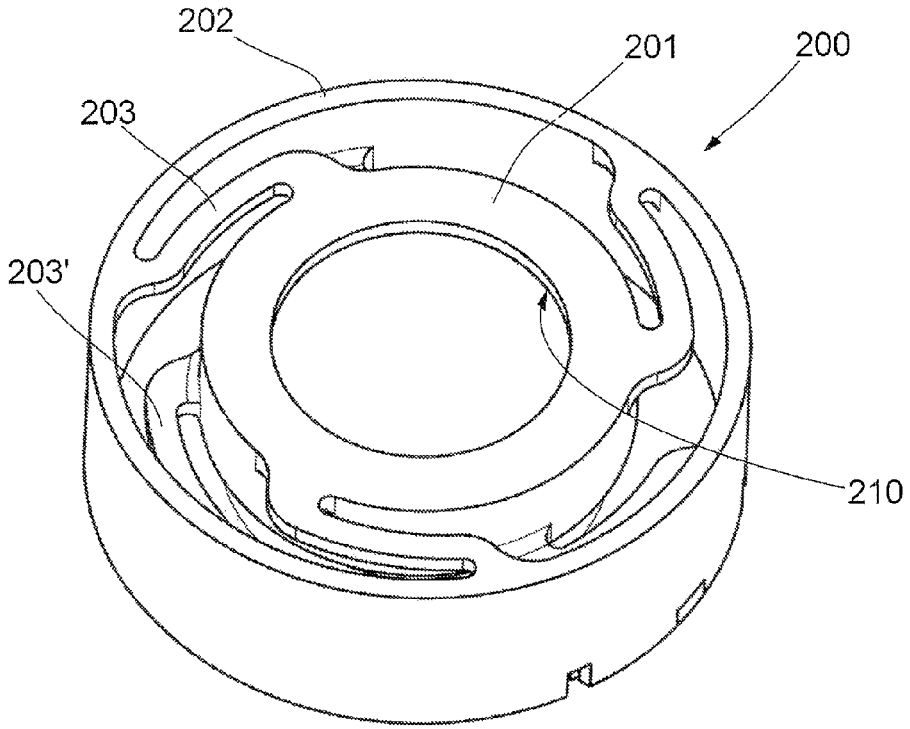
FIG. 8 is a perspective view of a second embodiment of a centering element for shakers according to the present invention.
Figure 9:
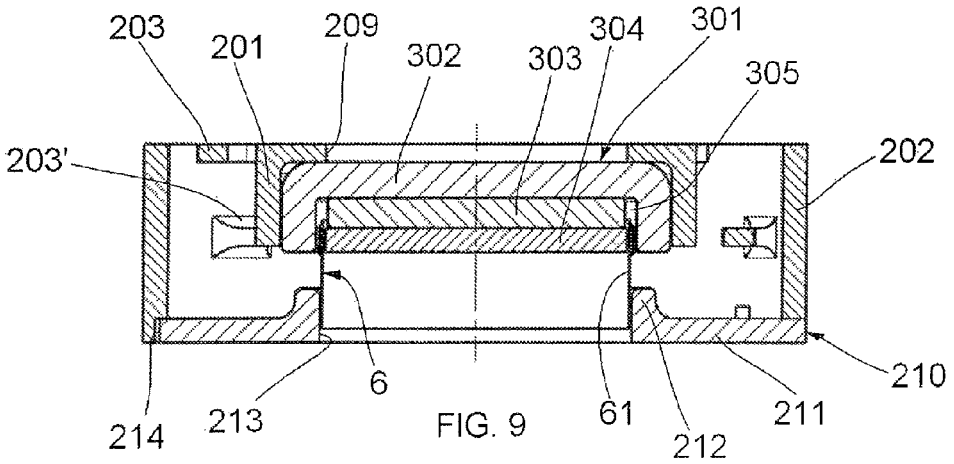
FIG. 9 is an axial cross-sectional view of the centering element of FIG. 8 with the addition of magnetic unit and sound coil.

FIGS. 8 and 9 illustrate a second embodiment of a centering element (200) for shakers according to the invention, wherein parts of the centering element that are the same or correspond to the ones described above are indicated with the same numerals increased by "100", omitting a detailed description.

In such a case, the magnetic unit (301) of the shaker is small and comprises a cup (302), a disc-shaped magnet (303) and a lower polar plate (304). Therefore the air gap (305) is generated between the internal surface of the cup (302) and the peripheral surface of the lower polar plate (304).

The central shank (201) of the centering element (200) is fixed to the cup (302) of the magnetic unit (301). To that purpose the central shank (201) of the centering element is basically shaped as an overturned cup with a central hole (209) in the upper part.

The lower cylindrical part (61) of the sound coil (6) is fixed to the shank (212) of a lid (211) that acts as rigid element (210) for transfer of vibrations. To that purpose, the shank (212) of the lid is provided with a central hole (213) inside which the lower cylindrical part (61) of the sound coil is coupled.

The lid (211) has a peripheral region (214) that is coupled with the peripheral shank (202) of the centering element by means of fit-in or bayonet coupling, in such a way to allow for self-centering of the sound coil (6) in the air gap (305) of the magnetic circuit (301).

Between the central shank (201) and the peripheral shank (202) of the centering element elastic spokes (203, 203') are provided, being basically similar to the spokes (103, 103') of the first embodiment.

The centering element (200) is functional in case of small shakers because it allows for having flat springs (203, 203') that are not dimensionally limited by the diameter of the magnetic unit (1), as it happens in the centering element (100) of the first embodiment of the present invention. In fact, if the centering element (100) is used with a small magnetic circuit, the spokes that represent the flat springs (103, 103') would be too small and the desired stretchiness and functionality would be impossible to achieve.

Also the centering element (200) provides for self-centering assembly of two (plastic) parts, the first one containing the magnetic circuit (301) and the two flat springs (203, 203') and the second one containing the coil (6). In this way self-centering of the coil (6) in the air gap (305) is obtained.

The centering element (200) can be functionally used also in larger shakers (if space is not a problem, being larger, or simply if largely-dimensioned spokes are needed for functional reasons).

Preferably the centering system (200) is injection-molded in one piece. However, also the centering element (200) can be made of two parts coupled together as illustrated in FIGS. 6 and 7.

Numerous variations and modifications can be made to the present embodiments of the invention by an expert of the field, while still falling within the scope of the invention as claimed in the enclosed claims.

The invention claimed is:

1. Shaker-type transducer comprising:

a magnetic unit composed of a magnet disposed between a first polar plate and a second polar plate to a toroidal shaped air gap, a sound coil comprising a cylindrical support with winding, said sound coil being arranged in the air gap and said cylindrical support having a protruding portion that protrudes externally from said second polar plate, a centering element positioned between said magnetic unit and said sound coil and configured to maintain the coil centered with respect to the magnetic unit during the relative axial movement of the coil with respect to the magnetic unit and vice versa, a rigid element comprising a shank connected to said cylindrical support of the sound coil and adapted to be anchored to a surface to transfer the sound vibrations generated by the magnetic unit, said centering element comprises a central cylindrical shank fixed to said protruding portion of the cylindrical support of the coil or to said magnetic unit, a peripheral cylindrical shank fixed to said magnetic unit or said cylindrical support of the sound coil, said peripheral cylindrical shank being higher than the central shank, and a plurality of elastic spokes disposed between said central shank and said peripheral shank, wherein said spokes are shaped as a flat plate with respect to a plane orthogonal to the axis of the central shank coinciding with the axis of the coil, said spokes having a lower thickness than the height of said central shank and being equally spaced, said centering element comprising a first set of spokes that lie on a first plane orthogonal to the axis of the central shank and at least a second set of spokes that lie on at least a second plane orthogonal to the axis of the central shank, at a certain distance from said first plane, the spokes of the first set being angularly equidistant and the spokes of the second set being angularly equidistant and staggered with respect to the spokes of the first set, said centering element thereby configured so as to be capable of being injection-molded from plastic materials using only one mold.

2. Shaker-type transducer as claimed in claim 1, wherein the spokes are made of plastic material coated with damping material.

3. Shaker-type transducer as claimed in claim 1, wherein the cylindrical support of the sound coil is filled with damping material.

4. Shaker-type transducer as claimed in claim 1, wherein the centering element is obtained in one piece by molding plastic materials.

5. Shaker-type transducer as claimed in claim 1, wherein the centering element is made by assembling two parts.

6. Shaker-type transducer as claimed in claim 1, wherein said central cylindrical shank of the centering element is fixed to said protruding portion of the cylindrical support of the coil; and said peripheral cylindrical shank is fixed to said second polar plate of the magnetic unit.

7. Shaker-type transducer as claimed in claim 1, wherein:

said first polar plate of the magnetic unit is shaped as a cup;

said central shank of the centering element is fixed to said cup of the magnetic unit; and said rigid element for transfer of sound vibrations comprises a shank fixed to said cylindrical support of the sound coil and is shaped as a lid that is fixed to said cylindrical support of the sound coil.

* * * * *